US005238462A

United States Patent [19]

Cinke et al.

[11] Patent Number: 5,238,462

[45] Date of Patent: Aug. 24, 1993

[54] STAIR CLIMBING EXERCISE APPARATUS UTILIZING DRIVE BELTS

[75] Inventors: Steven J. Cinke, Crete; Michael K. Platt, Prospect Heights; David J. Thum, Roselle, all of Ill.

[73] Assignee: Life Fitness, Franklin Park, Ill.

[21] Appl. No.: 658,156

[22] Filed: Feb. 20, 1991

[51] Int. Cl.[5] ..... A63B 22/04

[52] U.S. Cl. ..... 482/52; 482/51

[58] Field of Search ..... 272/70, 73, 69; 74/138; 482/51, 52, 53

[56] References Cited

U.S. PATENT DOCUMENTS

| | | | |
|---|---|---|---|
| 3,497,215 | 2/1970 | Harrison et al. . | |
| 3,628,791 | 12/1971 | Garcia . | |
| 3,704,886 | 12/1972 | Kay et al. | 272/73 |
| 3,747,924 | 7/1973 | Champoux | 272/70 |
| 3,848,467 | 11/1974 | Flavell | 73/379 |
| 4,082,267 | 4/1978 | Flavell | 272/125 |
| 4,574,649 | 3/1986 | Seol | 74/138 |
| 4,676,501 | 6/1987 | Hoagland et al. . | |
| 4,685,666 | 8/1987 | DeCloux | 272/70 |
| 4,687,195 | 8/1987 | Potts | 272/69 |
| 4,708,128 | 11/1987 | Ancillotti | 272/73 |
| 4,708,338 | 11/1987 | Potts | 272/70 |
| 4,720,093 | 1/1988 | Del Mar | 272/70 |
| 5,013,031 | 5/1991 | Bull | 272/70 |
| 5,033,733 | 7/1991 | Findlay . | |

OTHER PUBLICATIONS

TECS Pak Brochure-"Uses of Polyurethane and Rubber", Copy received Jul. 27, 1990 in Grp 330, Cl272/70.

*Primary Examiner*—Stephen R. Crow

*Attorney, Agent, or Firm*—Jenner & Block

[57] ABSTRACT

A stair type exercise apparatus is disclosed in which two pedal members reciprocate. The pedal members can either be directly connected together by a cog drive belt which in turn operates through a transmission providing a resistive force to the pedals or the pedals can be individually connected to the transmission by a drive belt. The resistive force is supplied by an alternator which is controlled by a computer.

15 Claims, 4 Drawing Sheets

STAIR CLIMBING EXERCISE APPARATUS UTILIZING DRIVE BELTS

TECHNICAL FIELD

The invention relates to the field of exercise equipment for simulating stair climbing and in particular to stair climbing apparatus having pedal members operatively connected via a transmission to a source of resistance force.

BACKGROUND OF THE INVENTION

Stair climbing has become recognized as a particularly effective type of aerobic exercise and as a result, exercise machines facilitating this type of exercise are becoming increasingly popular for both home and health club use.

There have been a wide variety of approaches taken in designing stair climbing apparatus including the simulation of an actual stair case as illustrated in U.S. Pat. Nos. 3,497,215 and 4,687,195. Another popular approach has been to simulate the action of stair climbing by using a pair of reciprocating pedals. Examples of this approach are disclosed in U.S. Pat. Nos.: Des. 263,490, 3,316,819, 3,529,474, 3,628,791, 3,979,302, 4,496,147, 4,600,187, 4,676,501, and 4,720,093.

In U.S. Pat. No. 4,708,338, a stair climbing apparatus is disclosed where two pedals operate independently of each other and are connected to a force generating alternator through a speed increasing transmission that, in turn, is connected to the pedals by a pair of chains running over a pair of one way drive pulleys. A microprocessor is used to control the alternator so that a variety of exercise programs can be implemented.

In addition to stair climbing apparatus where two pedals operate independently of each other, a reciprocating type stair climbing apparatus disclosed in U.S. patent application Ser. No. 07/426,909 filed on Oct. 29, 1989 and assigned to the assignee of the present application discloses an apparatus where the two pedals are directly connected to each other, thereby allowing the range of pedal motion to be measured. The two pedals in the stair climbing apparatus disclosed in U.S. patent application Ser. No. 07/426,909 are connected by a drive chain which is also connected via a speed increasing transmission to a resistance force generating alternator. Speed information is transmitted to the microprocessor controlled alternator which, in turn, governs the rate at which the pedals reciprocate.

Chain driven climbing apparatus, however, tend to be noisy due to the characteristics of the drive chain. One source of the noise results from the chain running over chain sprockets in the apparatus. In addition, the inelasticity of the chain results in a certain roughness of pedal operation as the pedals reciprocate from a depressed to an elevated position and vice-versa.

Along with being noisy, drive chains are relatively expensive although chain driven stair climbing apparatus such as the apparatus disclosed in U.S. patent application Ser. No. 07/426,909 have been commercially successful. Not only are the drive chains themselves expensive, but so are the many corresponding transmission components of the stair climbing apparatus such as the sprockets which must be designed for the wear and tear caused by the heavy drive chain. These components must be of sufficient size and durability to accommodate a drive chain thereby adding to the cost of the stair climbing apparatus.

As a result it is desirable to decrease the manufacturing expense, improve the smoothness of pedal motion and decrease noise of stair climbing apparatus.

SUMMARY OF THE INVENTION

It is therefore an object of this invention to provide a stair climbing exercise apparatus having two pedal members and a resistive force generator for applying a resistance force to the pedal members where the transmission connecting the pedal members to the force generator includes at least one drive belt.

It is an additional object of this invention to provide a stair climbing exercise apparatus having two pedal members where resistance to the pedal members is provided by an alternator. The pedals members are connected to the alternator by a speed increasing transmission. The transmission, in turn, is connected to the pedal members by least one drive belt. A pair of one way clutches is connected by the drive belt or belts to the pedal members such that the alternator provides a resistance force only when the pedals are operated by a user in a stair climbing direction.

It is a further object of this invention to provide a stair climbing apparatus incorporating a drive belt which is operatively connected to both pedal members.

It is still another object of this invention to provide a stair climbing apparatus wherein the two pedals operate independently of each other. Each pedal is connected to the transmission by a separate drive belt.

It is a yet another object of the invention to provide a method of maintaining positive engagement of the drive belt on certain pulleys in the transmission.

It is an additional object of the invention to provide for increased damping and shock absorption at the lower end of pedal travel. Generally elliptically shaped resilient members having damping members located within are secured to the apparatus frame to absorb the impact of the pedal members.

DETAILED DESCRIPTION OF THE INVENTION

Figure 1:
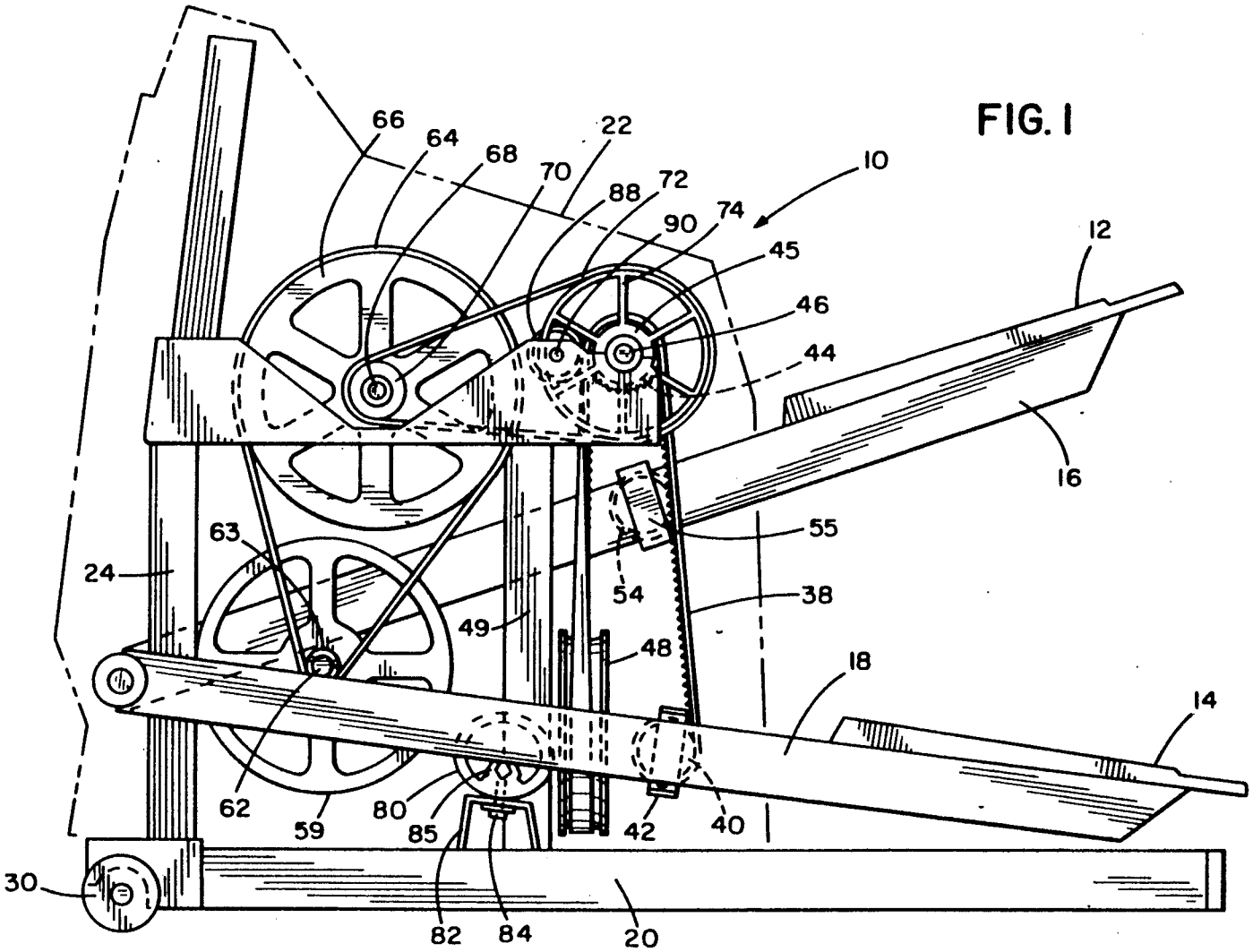
FIG. 1 is a partially sectioned away side view of an embodiment of the stair climbing exercise apparatus constructed in accordance with the invention.
Figure 2:
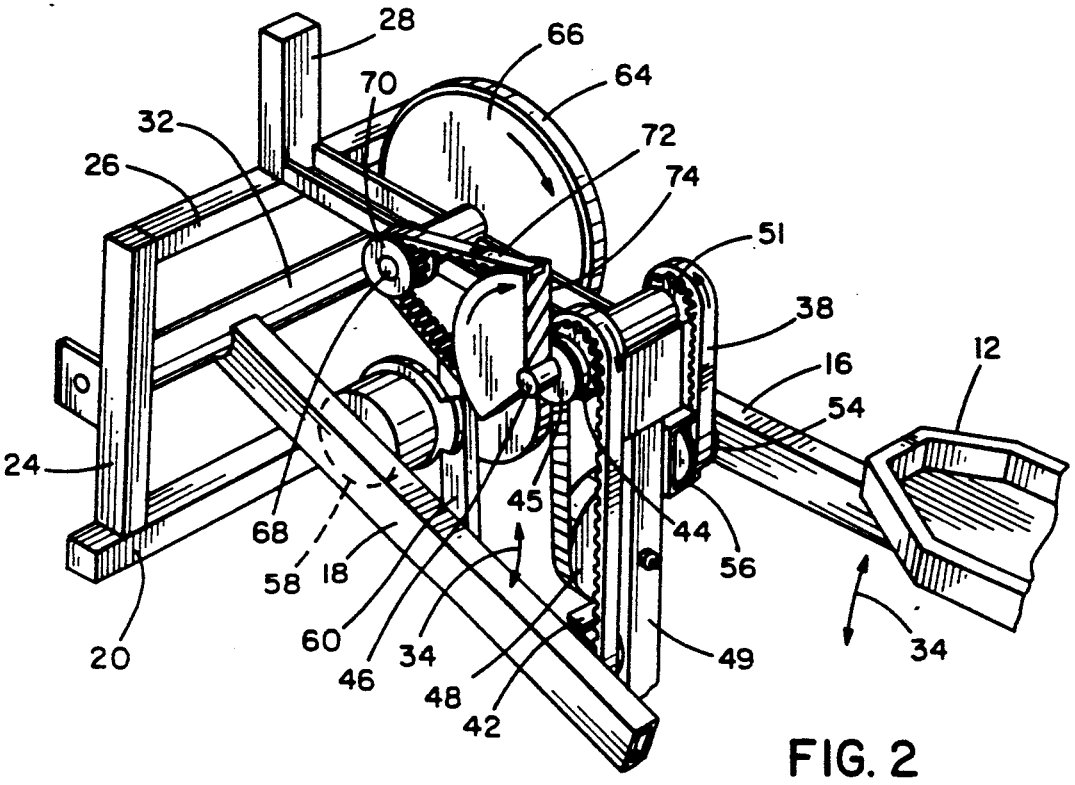
FIG. 2 is a partially sectioned away right perspective view of the stair climbing apparatus in FIG. 1.

FIG. 1 provides a partially sectioned away side view of a pedal type stair climbing exercise apparatus 10. A pair of foot pads 12 and 14 are attached to a pair of pedal members 16 and 18 respectively which move up and down in a reciprocating motion in order to provide a user who is standing on the pads 12 and 14 with a simulated stair climbing exercise program. A frame support base member 20 provides support for the apparatus 10. Also attached to the base member 20 is a housing 22 and vertical support 24. As shown in FIG. 2, both of the vertical support members 24 are attached to a frame cross member 26 which serves to provide support for a vertical upper member 28 of the frame. The vertical upper member 28, in turn, serves to provide support for a control and display panel (not illustrated in the drawings) and a pair of handrails (also not illustrated in the drawings) in a manner similar to the apparatus of U.S. patent application Ser. No. 07/426,909. A pair of wheels 30 are rotatably secured to base member 20 in order to provide an efficient means to move the apparatus 10.

As shown in FIGS. 1 and 2, the pedal members 16 and 18 are secured by pair of bearings 31 to a rod 32 that, in turn, is attached to vertical support members 24. The bearings 31 permit the pedal members 16 and 18 to reciprocate independently in a vertical plane as indicated by an arrow 34 in FIGS. 2 and 3. Since the rotation of the pedal members 16 and 18 and hence the foot pads 12 and 14 is limited to a relatively small angle, the horizontal displacement of the foot pads 12 and 14 will be relatively small so that the physical activity of stair climbing can be accurately simulated on apparatus 10.

Figure 3:
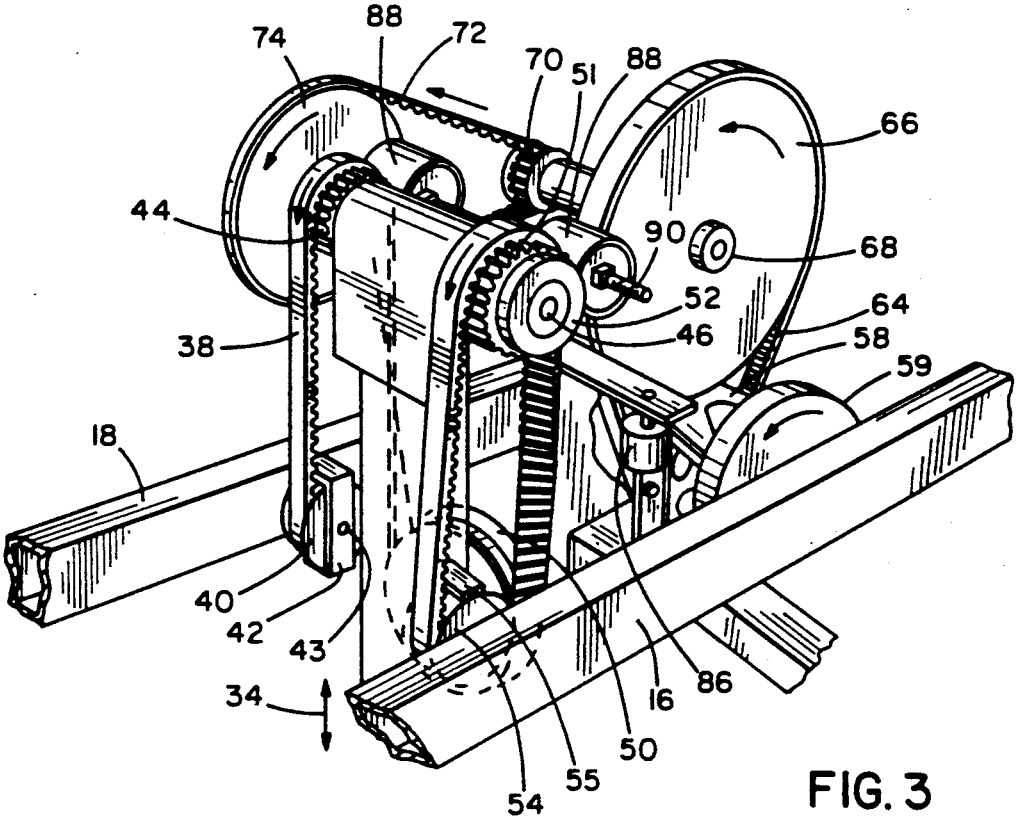
FIG. 3 is partially sectioned away left perspective view of the stair climbing apparatus in FIG. 1.

The pedal members 16 and 18 in this embodiment of the invention as illustrated in FIGS. 1, 2 and 3 are cross-connected by a drive belt 38 such that the pedal members 16 and 18 are constrained to move in opposite directions. In order to achieve this purpose, a number of different drive belts can be utilized although cog belts are preferred. A number of different cog belts can be used. For example, synchronous belts or belts having a trapezoidal tooth profile, HTD belt manufactured by Gates, Rubber Company located at 990 S. Broadway, Denver Colo., 80217 RPP-HPR belt manufactured by Pirelli Industial Products, 1405 Jamike Dr., Erlanger, Ky., 41018, polychain belts manufactured by Gates can be used although it is most preferable to utilize either HTD or RPP belts due to the optimal combination of power transmission capacity and cost.

Because the pedal members 16 and 18 are cross-connected by the drive belt 38 when the first pedal member 16 is driven in an downward direction, the second pedal member 18 will be constrained to move in a upward direction and vice versa. To cross-connect the pedal members 16 and 18, the ends of the drive belt 38 is secured to each of the pedal members 16 and 18. To secure the ends of the drive belt 38 to the pedal members 16 and 18, a number of methods such as clamps can be used. However, in the preferred embodiment a first end of the drive belt 38 is engaged to a first toothed pulley 40 which is non-rotatably secured to the pedal member 18 as shown in FIG. 3. In this embodiment, the end of the drive belt 38 is directly secured to the first toothed pulley 40 by a U-shaped clamp 42. The U-shaped belt clamp 42 serves to retain the cogs of the belt 38 in the teeth of the toothed pulley 40. The clamp 42 is secured over the pulley 40 to the pedal member 18 by a bolt 43 which permits rapid and convenient release of the end of the belt 18. This approach results in minimum wear on the end of the belt 38 as the pedal member moves up and down. Other arrangements for securing the drive belt 38 to the toothed pulley 40 can be utilized in addition to the retainer 42, such as a clamp extending over the pedal member 18 or even directly bolting the end of the belt 40 to the pulley 38.

The drive belt 38 is then engaged to a clutch pulley 44 that is secured to a one-way clutch 45. The one-way clutch 45 is, in turn, secured to a shaft 46 which is mounted for rotation on the frame. After the drive belt 38 traverses the clutch pulley 44, it is rotated 90° and continues to a non-toothed pulley 48 which is mounted for rotation on a vertical frame member 49. The non-cogged side of the belt 38 is run over the pulley 48. The drive belt 38 is then lead, after being rotated 90°, to a second toothed clutch pulley 51, which is secured to a second one-way clutch 52 on the shaft 46. The drive belt 38 is then lead to a second toothed pulley 54 attached for non-rotation to the second pedal member 16. As with the first pulley 40, the drive belt 38 is preferably secured to the second toothed pulley 54 with a U-shaped clamp 55.

In order to regulate the rate at which the pedal members 16 and 18 can be moved and thus control the rate of simulated stair climbing, a variable source of resistance force is provided. Preferably, the variable source of resistance force is an alternator 58 and its associated flywheel 59 secured to a vertical frame member 60 as shown in FIG. 2. Rotational resistance is applied from the alternator 58 to a rotatable shaft 62 and then to the drive belt 38 by a double reduction transmission which includes: a pulley 63 secured to the shaft 62; a belt 64 connected to the pulley 63 and a pulley 66 coupled to a rotatable shaft 68; a second pulley 70 coupled to the shaft 68; and a drive belt 72 connecting the second pulley 70 to a third pulley 74 which is in turn coupled to the shaft 46. The second and third drive belts 64 and 72 can be poly-V belts or cog belts which promote quiet operation of apparatus 10, but drive chains or other types of power transmitting devices can be used as well. Preferably, as shown in FIG. 2, the belt 64 is a poly-V belt and the belt 72 is a cog belt with both the pulleys 70 and 74 being toothed. The second shaft 68 is rotatably secured to the frame by a pair of bearings at each end to the end of the frame (not illustrated in the drawings). Similarly, the shaft 46 is secured at each end to the frame by bearing assemblies (not shown in the drawings). The one-way clutch assemblies 45 and 52 are used to connect the clutch pulleys 44 and 51 to the shaft 46. The function of the one way clutches 45 and 52 is to ensure that the shaft 46 and hence the alternator 58, as indicated by the arrows in FIGS. 2 and 3, only rotate in one direction even though the clutch pulleys 44 and 51 will be rotating in both directions due to the reciprocating motion of the pedal members 16 and 18 as transmitted to the clutch pulleys 44 and 51 by the drive belt 38.

Figure 5:
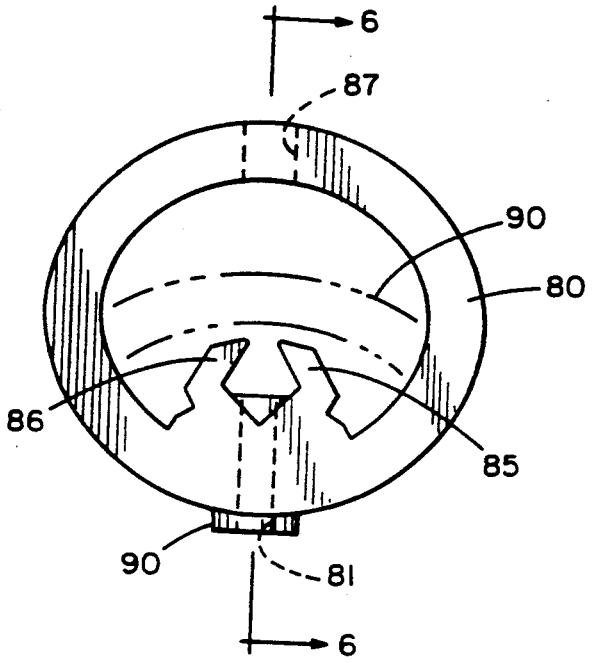
FIG. 5 is a side view of a shock absorption member.
Figure 6:
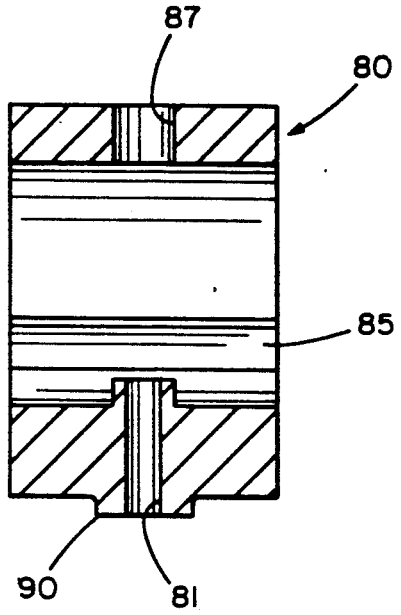
FIG. 6 is a sectional end view of the shock absorption member of FIG. 5 taken along lines 6—6.

In order to prevent undesirable high impact loads on the user's legs and feet caused by impact of the pedal members 16 and 18 at the lower limit of their travel, resilient stops are included in the apparatus 10. Not only is it considered desirable to limit the lower portion of the stroke of each pedal member 16 and 18 in order to prevent excessive foot impact, it is further considered desirable to gradually reduce or dampen the velocity of the pedal members 16 and 18 as they approach the lower limits of their strokes. One approach to solving this problem involves placing springs or other resilient members under the pedal members 16 and 18 to cushion the bottom portion of the user step motion. Another approach is to use the cross-damping method as discussed in U.S. patent application Ser. No. 07/426,909 and herein incorporated by reference. The preferred method, however, utilizes a pair of resilient members 80 located as shown in FIG. 1 (the second resilient member is not shown) and illustrated in detail in FIGS. 5 and 6. Each of the resilient members 80 includes a hole 81 in the lower portion and is secured to a support 82 by a bolt or a pin 84 inserted through the hole 81 and positioned so as to contact the lower surface of the pedal members 16 and 18 at their lower limit of travel. The supports 82 are secured to the frame 20 by any conventional method, such as welding or brazing. The resilient members 80 are annular with a generally elliptically-shaped configuration. In the preferred embodiment, a pair of resilient damping projections 85 and 86 extend upwardly from the inside surface of the resilient members 80. The projections 85 and 86 substantially increase the damping effect as the pedal members 16 and 18 approach the lower limit of travel. Alternatively, a single damping member indicated by dashed lines 90 in FIG. 5 can be used. Also, to prevent rotation of the resilient member 80 on the support 82, the member 80 is configured with a square anti-rotation block 92. As a result, it is not necessary to use the previously mentioned cross-damping method to achieve adequate damping in a stair climbing apparatus where the pedal members are connected as by the belt 38. The resilient members 80 are preferably molded in one piece from a suitable material having the desired resilient and wear characteristics, including polystyrene, polycarbonate, polyurethane, polyester, or mixtures thereof, but are preferably made of polyphenylene oxide. TECSPAC® bumpers, made by Eldyn, a division of Autoquip Corporation of Guthrie, Okla., and made of an Eldyn proprietary material including polyurethane and DuPont HYTREL® (polyester elastomers) have proved especially successful, although any other suitable material may be used. In their preferred embodiment, the resilient members 80 have a free uncompressed height in the range of 1.50 to 3.0 inches and the hardness of the material is preferably in the range of shore 30A to shore 8A; where the resilient members have a compressed height in the range of 0.5 to 2.0 inches. Since the elliptical members 80 have significantly greater wear characteristics, their use is preferred over conventional springs. Access to the bolt 84 is provided through the top of the resilient member 80 by a second hole 87 as shown in FIG. 6.

Although the drive belt 38, due to its elastomeric nature, provides for smoother operation than a drive chain and substantially reduces jerking motion of the pedal members 16 and 18, it may be desirable to also limit the upper stroke of the pedals 16 and 18. To accomplish this objective, a rubber stop 86 secured to the frame as illustrated in FIG. 3, is provided for each pedal member 16 and 18 although it is possible to use a resilient member of the type shown at 80 as well.

Figure 7:
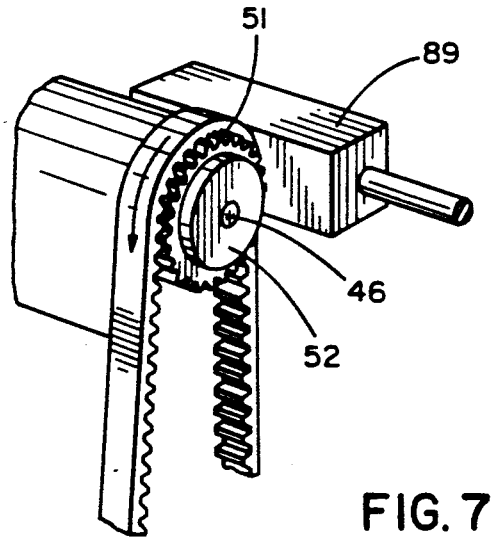
FIG. 7 is a partial perspective view of an alternative embodiment of the engagement mechanism of the stair climbing apparatus shown in FIG. 1.

In addition to limiting the jerking motion of the pedal members 16 and 18, it is desirable to limit slack in the drive belt 38 by using, for example, the previously mentioned cross-damping arrangement. Slack in the belt 38 can result in the cogs in the belt 38 to disengage from the grooves in the clutch pulleys 44 and 51 because of the inherent pitch mismatch between the width of the cogs and the width of grooves on the clutch pulleys 44 and 51. In one approach to limiting slack the drive belt 38 is stretched a sufficient amount under a tension load so as to allow the pitch of the drive belt 38 to match the clutch pulley pitch. If there is not sufficient tension on the drive belt 38, the slack caused by pedal member movement, the cogs may disengage from the teeth of the clutch pulleys 44 and 51. This problem is magnified at the top of the stroke where the load on the drive belt 38 is nearly zero resulting in insufficient tension on the drive belt 38 to retain the cog in the grooves of the pulleys 44 and 51. The above-mentioned cross-damping method can alleviate some of the cog retention problem. Preloading the drive belt 38 to a point where the drive belt 38 with sufficient tension can also alleviate some of the cog retention problem. But in the preferred embodiment of the invention, a positive engagement arrangement is utilized to prevent cog slippage. An added advantage of utilizing positive engagement is that in addition to ensuring engagement it serves to evenly distribute the load over the portion of the belt 38 engaging the clutch pulleys 44 and 51. Since the drive belt 38 transmits the force generated by the alternator 58 to the pedal members 16 and 18 via the clutch pulleys 44 and 51, a positive engagement mechanism provides a particularly efficient way of ensuring that the portion of the drive belt 38 required to transmit torque resistance to the force generated by the pedal members 16 and 18 remains engaged with the clutch pulleys 44 and 51. As long as it provides sufficient engagement of the belt 38 with the clutch pulleys 44 and 51, the engagement mechanism can be operatively connected to any portion of the drive belt 38. However, in the embodiment of the invention shown in FIGS. 1–3, it is preferable to have the engagement mechanism contact the drive belt 38 on the portion of the belt 38 where it is engaged with the clutch pulleys 44 and 51 above the pulley 51. Such placement ensures that there is sufficient engagement to distribute the load evenly over the portion of the drive belt 38 engaging the clutch pulleys 44 and 51 so that torque is efficiently transmitted from the belt 38 to the one way clutches 45 and 52. A number of different engagement mechanisms can be utilized to accomplish this objective. For example rubbing blocks 89 can be utilized to achieve the effect desired (as shown in FIG. 7). However, better results are achieved by the use of a pair of engagement idlers both indicated by 88 in FIG. 3. The idlers 88 are rotatably attached to an idler shaft 90 at a position behind the clutch pulleys 44 and 51 in order to most effectively transmit torque resistance to the force generated by the pedal members 16 and 18. Optimally, the first shaft 46 is aligned in parallel with the idler shaft 90 thereby facilitating full load sharing of all the cogs of the drive belt 38 which are in engagement with the grooves of the clutch pulleys 44 and 51.

Figure 4:
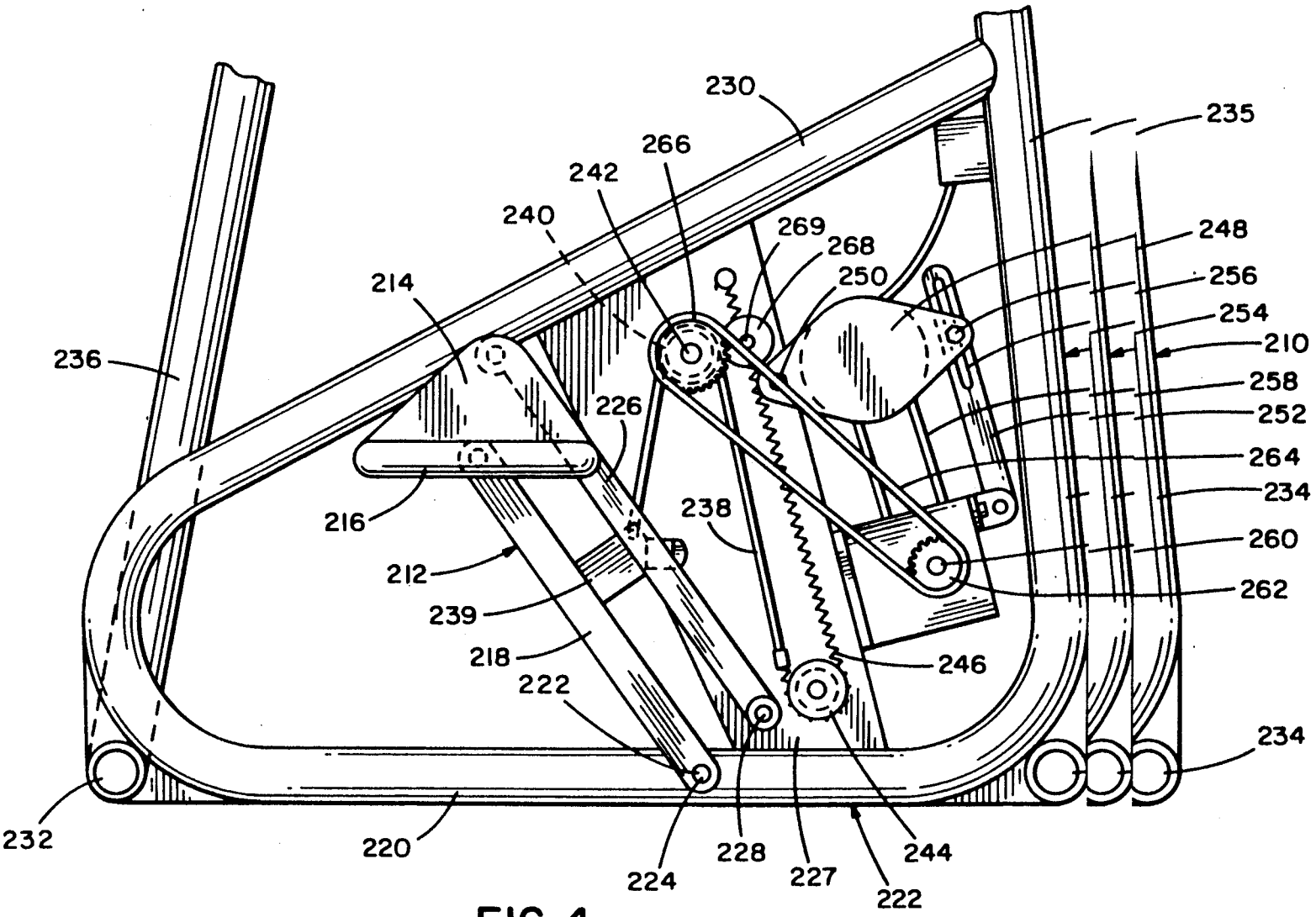
FIG. 4 is a right side view of another embodiment of the stair climbing exercise apparatus constructed in accordance with the present invention.

FIG. 4 provides a side view of a second embodiment of the invention. As with the previously described embodiment 10, a stair climbing apparatus 210 has a pair of pedal members 212 (the second pedal member is not shown in FIG. 4 but is similar to pedal member 212). Details of the second embodiment of the present invention are further disclosed in U.S. Pat. No. 4,708,338 which is herein incorporated by reference. Each pedal member 212 has a pedal 214 (the second pedal is not shown in FIG. 4 but is similar to pedal 214) which include pads 216. The pads 216 are generally aligned parallel to the floor. In addition to the pedals 214, each pedal member 212 comprises a pedal arm 218 (the second pedal arm is not shown in FIG. 4 but is similar to pedal arm 218) upon which the pedal 214 is pivotally mounted. The pedal arm 218, itself, is pivotally mounted to a base member 220 of a frame 222 at shaft 224. Optionally, a support arm 226 can be provided to add strength and durability to the pedal member 212. As is the case with the pedal arm 218, the support arm is pivotally mounted upon a plate 227 at a second shaft 228. The plate 227 is attached to the base member 220 and a diagonal support member 230. To provide balancing support to the frame 222, a pair of 10 spaced members 232 and 234 are provided on opposite ends of the base member 220. The diagonal support member 230 extends at an acute angle upwardly from the spaced member 232 and joins a vertical support member 235 extending upwardly from spaced member 234. In addition, a pair of handrails 236 (the second handrail is not shown in FIG. 4 but is similar to handrail 236) are provided which join vertical support member 235 to form the frame 222.

In this embodiment of the invention as illustrated in FIG. 4, the pedal members 212 oscillate independently of each other. As a result, when one pedal member 212 moves, it is not necessary that the second pedal member 212 be in motion also. Each pedal member 212 is connected to a cog belt 238. The drive belt 238 can be connected to the pedal member 212 in any way suitable to fixedly secure the belt 238 to the pedal member 212. For example, the belt 238 can be connected to the pedal member 212 by a winglet 239. Other suitable means such as leaf springs and even pulleys upon which the belt 238 is clamped or retained of the type shown in FIG. 1 can be utilized to connect the pedal member 212 to the drive belt 238. Once connected to the pedal member 212, the drive belt 238 is then engaged with a grooved clutch pulley 240 mounted on a shaft 242 and then continues down to a pulley 244. As shown in FIG. 4, the drive belt 238 actually is connected to a spring 246 prior to engaging the pulley 244. However, it is also understood that the drive belt 238 can engage the pulley wheel 244 and then after engagement, be connected to a shortened version of the spring 246. The spring 246 has sufficient tension to return each pedal member 212 in an upper position as illustrated in FIG. 4, that is, the pedal member 212 is not in a depressed position as when a user steps upon pedal 214. When the user steps on the pedal 214, the spring 246 will extend so as to allow the drive belt 238 to move downward towards the floor. When the user's foot is lifted, the spring 246 will cause the pedal 214 to return to the upright position as illustrated in FIG. 4.

In order to regulate the rate at which each pedal member 212 can be moved and thus control the rate of stair climbing, a variable resistance force in the form of an alternator 248 is provided. The alternator 248 is fixedly secured on one side to plate 227 by a bolt 250 and on the other side, it is slidably secured to a bar 252. The bar 252 has a slot 254 through which a bolt 256 which is threaded through an aperture in the alternator 248 can be slid to adjust the position of the alternator with respect to the bar 252. Rotational resistance is applied from the shaft of the alternator 248 (not illustrated in FIG. 4) by a speed increasing transmission which includes: a second drive belt 258 connected to a first pulley (not illustrated in FIG. 4) coupled to a shaft 260; a second pulley 262 also coupled to shaft 260; and a third drive belt 264 connecting the second pulley 262 to a third pulley 266 coupled to the first shaft 242. The belts utilized in this embodiment of the invention can be similar to the drive belts discussed in the first embodiment of the invention.

In addition, a pair of one way clutches (not illustrated in FIG. 4) are utilized to connect each clutch pulley 240 to the first shaft 242. The function of the one way clutches is to ensure that the first shaft 242 and hence the alternator 248 can only rotate in one direction even though each clutch pulley 240 will be rotating in both directions due to the reciprocating motion of each pedal member 212 transmitted by each drive belt 238 to its respective pulley 240.

As with embodiments of the invention shown in FIGS. 1-3, it is desirable to increase the smoothness of operation of the apparatus 210. Slack can cause the drive belt cogs to disengage from the clutch pulleys 240 because of the pitch mismatch between the cogs and the grooves on the clutch pulleys 240. Therefore, the drive belt 238 must be stretched a sufficient amount so as to allow the pitch of the cogs on the drive belt 238 to match the clutch pulley pitch. If there is not sufficient tension on the drive belt 238, the slack caused by pedal member movement can cause the drive belt to disengage from the teeth of the clutch pulleys 240. This problem is magnified at the top of a pedal member stroke where the load on the drive belt 238 is substantially reduced because there is nothing except the spring 246 to maintain tension upon the drive belt 238 as it and the pedal members 212 and 214 are travelling in an upward direction. Increasing the tension on spring 246 to a point where the drive belt 238 is sufficiently taunt can eliminate some of the cog engagement problem but would interfere with the operation of the apparatus 210. Thus, it is preferred to utilize a positive engagement mechanism to prevent cog disengagement. An added advantage of utilizing an engagement arrangement is that it ensures an evenly distributed load over the portion of the belt 238 engaging the clutch pulleys 240. The drive belt 238 transmits the alternator 248 resistance to the pedal members 212 at the clutch pulleys 240. A positive engagement mechanism, therefore, provides an efficient way of ensuring that the portion of the drive belt 238 needed to transmit torque resistance to the force generated by the pedal members 212 and 214 remains engaged with the clutch pulleys 240. As long it provides a sufficient amount contact of the belt 238 with the clutch pulleys 240, the engagement mechanism can be located on any portion of the drive belt 238. However, it is preferable to have the engagement mechanism contact the drive belt 238 at a position on the rear portion of clutch pulleys 240. Such placement ensures that there is sufficient engagement to distribute the load evenly over the portion of the drive belt 238 engaging the clutch pulleys 240. A number of different engagement mechanisms can be utilized. For example, rubbing blocks can be utilized to achieve the effect desired. However, better results are achieved by the use of a pair of engagement idlers indicated by 268, one for each pulley 240. The idlers 268 are rotatably attached to an idler shaft 269 at a position behind the clutch pulleys 240 in order to most effectively transmit torque resistance to the pedal members 212 and 214. Optimally, the first shaft 242 is parallel with the idler shaft 269 thereby allowing full load sharing for all of the cogs of the drive belt 238 which are in engagement with the teeth of the clutch pulleys 44 and 51.

In summary, the drive belts 38 and 238 provide for a smoother, more comfortable and quieter operation of the exercise apparatus 10 and 210 respectively while at the same time reducing manufacturing and maintenance costs. The engagement idlers 88 and 268 are particularly effective in retaining the drive belts 38 and 238 on the pulleys thereby further enhancing the operation of the stair climbing apparatus 10 and 210. Efficiency is further enhanced by use of the improved resilient stops illustrated in FIGS. 5 and 6.

We claim:

1. A stair climbing exercise apparatus comprising:

a frame;

a first pedal member pivotally secured to said frame for rotational movement in a vertical direction;

a second pedal member pivotally secured to said frame for rotational movement in a vertical direction;

a resistance force generator having a shaft, said generator being secured to said frame;

transmission means including a pair of one way clutches for directly connecting each of said pedal member to said generator such that said generator is effective to apply a resistance force opposing said pedal member movement in a downward direction;

at least one drive belt connecting each said pedal member to said one way clutches;

a belt pulley which is rotationally secured to a lower portion of said frame leading said drive belt from said first one way clutch to said second one way clutch;

wherein said transmission means includes a first pulley secured to a first shaft rotatably attached to said frame and which is also secured to said one way clutches, a second pulley attached to a second shaft which is rotatably attached to said frame, a second drive belt connecting said first pulley to said second shaft and a third drive belt connecting said second pulley to said generator.

2. A stair climbing exercise apparatus comprising:

a frame;

a first pedal member pivotally secured to said frame for rotational movement in a vertical direction;

a second pedal member pivotally secured to said frame for rotational movement in a vertical direction;

a resistance force generator having a shaft, said generator being secured to said frame;

transmission means including a pair of one way clutches for directly connecting each of said pedal member to said generator such that said generator is effective to apply a resistance force opposing said pedal member movement in a downward direction;

at least one drive belt connecting each said pedal member to said one way clutches; and a belt pulley which is rotationally secured to a lower portion of said frame leading said drive belt from said first one way clutch to said second one way clutch;

wherein said drive belt is fixedly secured at one end to a first fixed pulley on said first pedal member and at an opposite end to a second fixed pulley on said second pedal member.

3. The apparatus of claim 2 further including a pair of belt retainers, said belt retainers securing said drive belt to said fixed pulleys.

4. The apparatus of claim 3 wherein each of said belt retainers includes a clamp, said clamp securing said drive belt to said fixed pulleys.

5. A stair climbing exercise apparatus comprising:

a frame;

a first pedal member pivotally secured to said frame for rotational movement in a vertical direction;

a second pedal member pivotally secured to said frame for rotational movement in a vertical direction;

transmission means for connecting each said pedal member to a force source such that said force source is effective to apply a resistance force opposing said pedal member movement; and stop means for resiliently limiting the downward motion of each of said pedal members with increasing force as each pedal member approaches a predetermined lower limit of said rotational movement, said resilient stop means including an elliptically configured member and a damping member secured within the inside of said elliptical member.

6. The apparatus of claim 5 wherein said stop means compressibly contacts each of said pedal members as each said pedal member approaches a predetermined lower limit.

7. The apparatus of claim 6 additionally including cross-connected damping means for resiliently damping the upward motion of each of said pedal members as each pedal member approaches a predetermined upper limit of said rotational movement.

8. The apparatus of claim 7 wherein said cross-connected damping means includes an elliptically shaped resilient member and including a damping member secured in a donut shape, said upper damping means within the inside of said elliptical member wherein said damping member further dampens the upward motion of said pedal members.

9. The apparatus of claim 5 wherein said damping member and said elliptical member are configured out of material selected from the group consisting of polyphenlyene oxide, polystyrene, polycarbonate, polyurethane, and polyester.

10. The apparatus of claim 5 wherein said stop means includes a plurality of said damping members.

11. The apparatus of claim 10 wherein said damping members include at least two projecting members extending upwardly from the lower inside surface of said elliptical member.

12. The apparatus of claim 5 wherein said damping member extends from one side of said elliptical member to the other.

13. The apparatus of claim 5 wherein said stop means is molded out of a single piece of material.

14. A stair climbing exercise apparatus comprising:

a frame;

a first pedal member pivotally secured to said frame for rotational movement in a vertical direction;

a second pedal member pivotally secured to said frame for rotational movement in a vertical direction;

transmission means for connecting each said pedal member to a force means such that said force means is effective to apply a resistance force opposing said pedal member movement, said transmission means including at least one drive belt and a pair of one way clutches operatively connecting each said pedal member to said force means; and engagement means for positively engaging said drive belts to said one way clutches thereby providing an effective load on said belt; said engagement means including a pair of engagement idlers.

15. A stair climbing exercise apparatus comprising:

a frame;

a first pedal member pivotally secured to said frame for rotational movement in a vertical direction;

a second pedal member pivotally secured to said frame for rotational movement in a vertical direction;

transmission means for connecting each said pedal member to a force means such that said force means is effective to apply a resistance force opposing said pedal. member movement, said transmission means including at least one drive belt and a pair of one way clutches operatively connecting each said pedal member to said force means; and engagement means for positively engaging said drive belts to said one way clutches thereby providing an effective load on said belt, said engagement means including at least one rubbing block.

* * * * *

UNITED STATES PATENT AND TRADEMARK OFFICE

CERTIFICATE OF CORRECTION

PATENT NO. : 5,238,462

DATED : August 24, 1993

INVENTOR(S) : Steven J. Cinke et al.

It is certified that error appears in the above-identified patent and that said Letters Patent is hereby corrected as shown below:

Column 3, line 4, before "vertical" insert -- a --

Column 3, line 4, after "support" insert -- member --

Column 3, line 68, delete "40" and insert -- 38 --

Column 3, line 68, delete "38" and insert -- 40 --

Column 7, line 3, delete "10"

Signed and Sealed this

Eighth Day of March, 1994

Bruce Lehman

*Attest:*

BRUCE LEHMAN

*Attesting Officer*

*Commissioner of Patents and Trademarks*